US008870626B2

(12) United States Patent
Wang

(10) Patent No.: US 8,870,626 B2
(45) Date of Patent: Oct. 28, 2014

(54) POLISHING PAD, POLISHING METHOD AND POLISHING SYSTEM

(75) Inventor: Yu-Piao Wang, Hsinchu County (TW)

(73) Assignee: IV Technologies Co., Ltd., Taichung (TW)

( * ) Notice: Subject to any disclaimer, the term of this patent is extended or adjusted under 35 U.S.C. 154(b) by 229 days.

(21) Appl. No.: 13/472,491

(22) Filed: May 16, 2012

(65) Prior Publication Data

US 2013/0017766 A1 Jan. 17, 2013

(30) Foreign Application Priority Data

Jul. 12, 2011 (TW) ..... 100124629 A

(51) Int. Cl.
*B24B 37/26* (2012.01)
*B24B 37/30* (2012.01)

(52) U.S. Cl.
CPC ..... *B24B 37/26* (2013.01); *B24B 37/30* (2013.01)
USPC ..... 451/59; 451/41; 451/285; 451/286; 451/398

(58) Field of Classification Search
CPC ..... B24B 37/32; B24B 37/04; B24B 37/26; B24B 29/00; B24B 5/00; B24B 7/10; B24B 7/30; B24D 11/04; B24D 13/00; B24D 13/14; B24D 49/00
USPC ..... 451/41, 285–290, 398
See application file for complete search history.

(56) References Cited

U.S. PATENT DOCUMENTS 5,690,540 A * 11/1997 Elliott et al. ..... 451/41
5,695,392 A * 12/1997 Kim ..... 451/288
6,080,049 A * 6/2000 Numoto et al. ..... 451/285
6,120,366 A * 9/2000 Lin et al. ..... 451/550
6,224,472 B1 * 5/2001 Lai et al. ..... 451/398
6,386,962 B1 * 5/2002 Gotkis et al. ..... 451/388
6,962,520 B2 * 11/2005 Taylor ..... 451/41
7,108,597 B2 * 9/2006 Muldowney ..... 451/527
7,131,895 B2 * 11/2006 Elmufdi et al. ..... 451/103
7,156,721 B2 * 1/2007 Palaparthi ..... 451/36
7,520,796 B2 * 4/2009 Muldowney ..... 451/56
8,496,512 B2 * 7/2013 Wang ..... 451/59
2005/0054277 A1 * 3/2005 Tsai et al. ..... 451/288
2007/0077866 A1 * 4/2007 Choi ..... 451/41
2007/0298693 A1 * 12/2007 Ichinoshime ..... 451/285
2008/0064308 A1 * 3/2008 Idani ..... 451/285
2008/0090503 A1 * 4/2008 Park et al. ..... 451/287

(Continued)

FOREIGN PATENT DOCUMENTS

WO WO 0071297 A1 * 11/2000

*Primary Examiner* — George Nguyen
(74) *Attorney, Agent, or Firm* — Jianq Chyun IP Office

(57) ABSTRACT

A polishing pad used in conjunction with a carrier ring to polish a substrate and has a motion direction when polishing is provided. The carrier ring has at least one carrier groove, and the substrate has a substrate radius. The polishing pad has a polishing layer and a surface pattern. The surface pattern has traversing grooves, and an angle between the tangent line of each traversing groove and the tangent line of the motion direction is not equal to 0 degree. Each traversing groove respectively has a traversing groove trajectory corresponding to the motion direction, and the traversing groove trajectory of the traversing groove has a trajectory width smaller than the substrate radius. At leading region of the carrier ring corresponding to the motion direction, the traversing grooves have at least one carrier compatible groove which aligns with the at least one carrier groove of the carrier ring.

51 Claims, 8 Drawing Sheets

(56) References Cited

U.S. PATENT DOCUMENTS

2008/0293339 A1* 11/2008 Huang et al. ..... 451/285
2009/0191791 A1* 7/2009 Fukushima et al. ..... 451/9
2009/0239446 A1* 9/2009 Fukuda et al. ..... 451/5
2010/0159810 A1* 6/2010 Muldowney ..... 451/56
2010/0159811 A1* 6/2010 Muldowney ..... 451/527
2013/0017766 A1* 1/2013 Wang ..... 451/59

* cited by examiner

POLISHING PAD, POLISHING METHOD AND POLISHING SYSTEM

CROSS-REFERENCE TO RELATED APPLICATION

This application claims the priority benefit of Taiwan application serial no. 100124629, filed on Jul. 12, 2011. The entirety of the above-mentioned patent application is hereby incorporated by reference herein and made a part of this specification.

BACKGROUND OF THE INVENTION

1. Field of the Invention

The invention relates to a polishing pad, a polishing method, and a polishing system. More particularly, the invention relates to a polishing pad, a polishing method, and a polishing system enabling a slurry to have a different flow distribution.

2. Description of Related Art

With the progress of the industries, planarization processes are often adopted as processes for manufacturing various devices. Chemical mechanical polishing (CMP) processes are often used in the planarization processes in the industries. General speaking, the chemical mechanical polishing processes are performed by supplying a slurry which has chemical mixtures on a polishing pad, applying a pressure on the article to be polished to press it on the polishing pad, and providing a relative motion between the article and the polishing pad. Through the mechanical friction generated by the relative motion and the chemical effects of the slurry, a portion of the surface layer of the article is removed to make the surface flat and smooth so as to achieve planarization.

Conventional polishing pad includes a polishing layer and a plurality of circular grooves disposed in the polishing layer. The circular grooves are disposed in a concentric arrangement in the polishing layer, for example. During the polishing process, a portion of the slurry flows outward in a radial direction from the circular grooves to the surface of the polishing layer due to the centrifugal force generated from the rotation of the polishing pad. Nevertheless, most of the slurry is still contained in the circular grooves and only a small portion flows to the surface of the polishing layer.

Another conventional polishing pad includes a polishing layer and a plurality of edge extending grooves disposed in the polishing layer. The edge extending grooves, for example, are disposed in a radial or spiral arrangement in the polishing layer and extend to an edge of the polishing layer. In the polishing process, the relative motion between a carrier ring in the polishing system and the edge extending grooves causes most of the slurry to be squeezed over the edge of the polishing layer by the carrier ring and then flows out, while only a small portion of the slurry flows between the surface of the polishing layer and the substrate.

During the polishing process, a flow distribution of the slurry affects polishing characteristics. Therefore, it is necessary to provide polishing pads which have different flow distributions for industry in response to the requirements of various polishing processes.

SUMMARY OF THE INVENTION

Accordingly, the present invention provides a polishing pad, a polishing method, and a polishing system enabling a slurry to have a different flow distribution.

The present invention further provides a polishing pad used in conjunction with a carrier ring to polish a substrate. The polishing pad has a motion direction when polishing, where the carrier ring has at least one carrier groove and the substrate has a substrate radius. The polishing pad includes a polishing layer and a surface pattern disposed in the polishing layer. The surface pattern having a plurality of traversing grooves. An angle between a tangent line of each of the traversing grooves and a tangent line of the motion direction is non-zero. Each of the traversing grooves respectively has a traversing groove trajectory corresponding to the motion direction. Each of the traversing groove trajectories has a trajectory width smaller than the substrate radius. Additionally, in a leading region of the carrier ring corresponding to the motion direction, the traversing grooves have at least one carrier compatible groove. Here, the at least one carrier compatible groove aligns with the at least one carrier groove.

The present invention further provides a polishing pad used in conjunction with a carrier ring to polish a substrate. The polishing pad has a motion direction when polishing, where the carrier ring has at least one carrier groove and the substrate has a substrate radius. The motion direction is perpendicular to a coordinate axis extended from an origin point. The polishing pad includes a polishing layer and a surface pattern disposed in the polishing layer. The surface pattern has a plurality of traversing grooves. The traversing grooves each has two terminals located at a first position and a second position of the coordinate axis respectively. A first distance is from the first position to the origin point. A second distance is from the second position to the origin point. The second distance is larger than the first distance, and a difference between the second distance and the first distance is smaller than the substrate radius. Additionally, in a leading region of the carrier ring corresponding to the motion direction, the traversing grooves have at least one carrier compatible groove. Here, the at least one carrier compatible groove aligns with the at least one carrier groove.

The present invention further provides a polishing method. In the polishing method, a polishing pad is provided. The polishing pad includes a polishing layer and a surface pattern disposed in the polishing layer. The surface pattern has a plurality of traversing grooves. A carrier is then provided. The carrier has a carrier ring for holding a substrate within the carrier, where the carrier ring has at least one carrier groove and the substrate has a substrate radius. Thereafter, the substrate is pressed on the polishing pad with the carrier to perform a polishing process. The polishing pad has a motion direction during the polishing process. An angle between a tangent line of each of the traversing grooves of the polishing pad and a tangent line of the motion direction is non-zero. Each of the traversing grooves respectively has a traversing groove trajectory corresponding to the motion direction. Each of the traversing groove trajectories has a trajectory width smaller than the substrate radius. Additionally, in a leading region of the carrier ring corresponding to the motion direction, the traversing grooves have at least one carrier compatible groove. Here, the at least one carrier compatible groove aligns with the at least one carrier groove.

The present invention further provides a polishing method. In the polishing method, a polishing pad is provided. The polishing pad includes a polishing layer and a surface pattern disposed in the polishing layer. The surface pattern has a plurality of traversing grooves. A carrier is then provided. The carrier has a carrier ring for holding a substrate within the carrier, where the carrier ring has at least one carrier groove and the substrate has a substrate radius. The substrate is pressed on the polishing pad with the carrier to perform a polishing process. The polishing pad has a motion direction during the polishing process, and the motion direction is perpendicular to a coordinate axis extended from an origin point. The traversing grooves each has two terminals located at a first position and a second position of the coordinate axis respectively. A first distance is from the first position to the origin point. A second distance is from the second position to the origin point. The second distance is larger than the first distance, and a difference between the second distance and the first distance is smaller than the substrate radius. Additionally, in a leading region of the carrier ring corresponding to the motion direction, the traversing grooves have at least one carrier compatible groove. Here, the at least one carrier compatible groove aligns with the at least one carrier groove.

The present invention further provides a polishing system including a polishing pad, a carrier, and a substrate. The polishing pad includes a polishing layer and a surface pattern disposed in the polishing layer. The surface pattern has a plurality of traversing grooves. The carrier has a carrier ring including at least one carrier groove. The substrate is held within the carrier and has a substrate radius. The polishing pad has a motion direction when the carrier presses the substrate on the polishing pad for polishing. An angle between a tangent line of each of the traversing grooves of the polishing pad and a tangent line of the motion direction is non-zero. Each of the traversing grooves respectively has a traversing groove trajectory corresponding to the motion direction. Each of the traversing groove trajectories has a trajectory width smaller than the substrate radius. Additionally, in a leading region of the carrier ring corresponding to the motion direction, the traversing grooves have at least one carrier compatible groove. Here, the at least one carrier compatible groove aligns with the at least one carrier groove.

The present invention further provides a polishing system including a polishing pad, a carrier, and a substrate. The polishing pad includes a polishing layer and a surface pattern disposed in the polishing layer. The surface pattern has a plurality of traversing grooves. The carrier has a carrier ring including at least one carrier groove. The substrate is held within the carrier and has a substrate radius. The polishing pad has a motion direction when the carrier presses the substrate on the polishing pad for polishing. The motion direction is perpendicular to a coordinate axis extended from an origin point. The traversing grooves each has two terminals located at a first position and a second position of the coordinate axis respectively. A first distance is from the first position to the origin point. A second distance is from the second position to the origin point. The second distance is larger than the first distance, and a difference between the second distance and the first distance is smaller than the substrate radius. Additionally, in a leading region of the carrier ring corresponding to the motion direction, the traversing grooves have at least one carrier compatible groove. Here, the at least one carrier compatible groove aligns with the at least one carrier groove.

In light of the foregoing, the traversing grooves of the polishing pad in the invention have at least one carrier compatible groove in the leading region of the carrier ring corresponding to the motion direction, and the at least one carrier compatible groove aligns with the at least one carrier groove. Thus, during the polishing process, the slurry generates the corresponding flow distribution along the grooves so as to provide better polishing efficiency.

In order to make the aforementioned and other features and advantages of the invention more comprehensible, several embodiments accompanied with figures are described in detail below.

BRIEF DESCRIPTION OF THE DRAWINGS

The accompanying drawings are included to provide further understanding, and are incorporated in and constitute a part of this specification. The drawings illustrate embodiments and, together with the description, serve to explain the principles of the invention.

DESCRIPTION OF EMBODIMENTS

Figure 1:
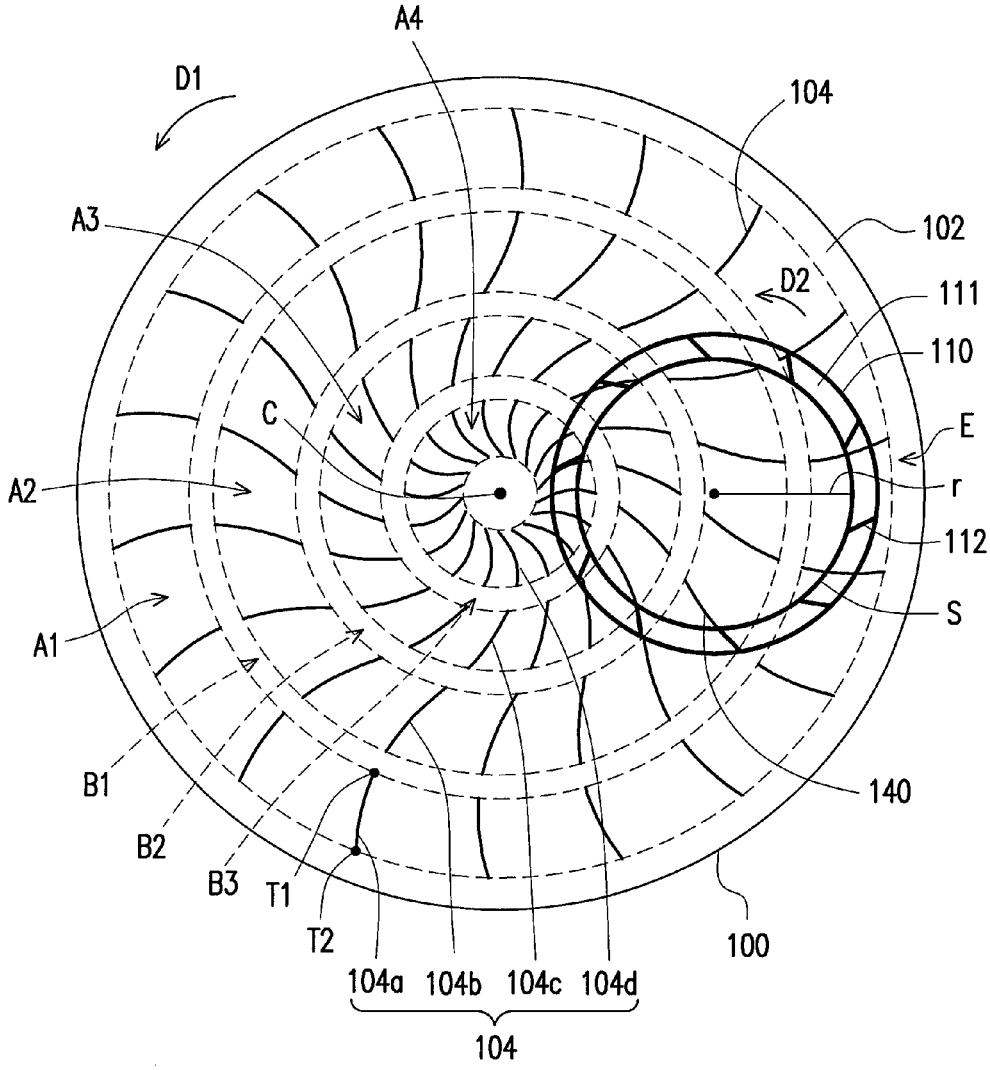
FIG. 1 is a schematic top view showing a polishing system according to an embodiment of the invention.
Figure 2:
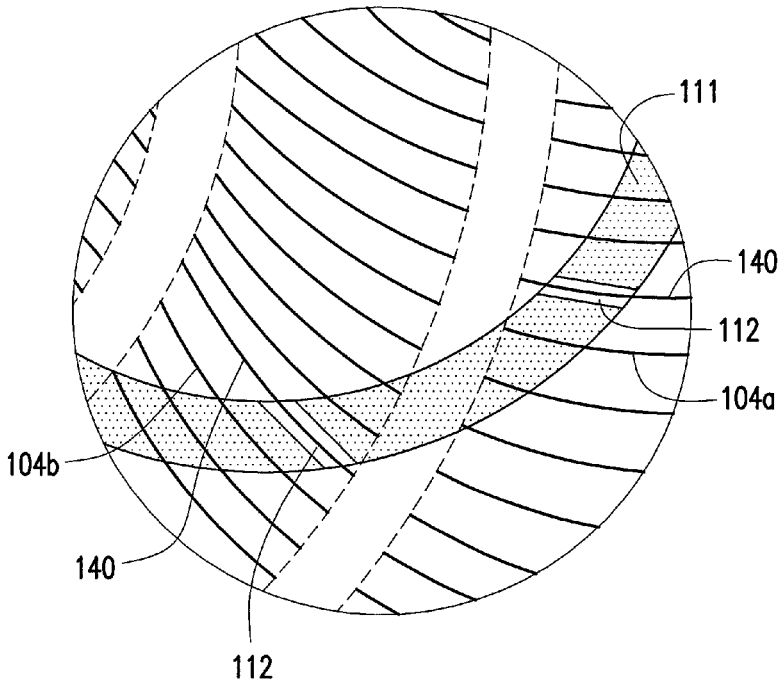
FIG. 2 illustrates a schematic partial enlarged view of a carrier ring in FIG. 1.

FIG. 1 is a schematic top view showing a polishing system according to an embodiment of the invention. FIG. 2 illustrates a schematic partial enlarged view of a carrier ring in FIG. 1. Referring to FIGS. 1 and 2, a polishing system of the present embodiment includes a polishing pad 100, a carrier 110, and a substrate S. The polishing pad 100 is used in conjunction with a carrier ring of the carrier 110. The polishing pad 100 includes a polishing layer 102 and a surface pattern 104 disposed in the polishing layer 102.

The polishing layer 102 may be made of polymer materials such as polyester, polyether, polyurethane, polycarbonate, polyacrylate, polybutadiene, or other polymer materials synthesized by suitable thermosetting resin or thermoplastic resin. In addition to the polymer materials, the polishing layer 102 may further include conductive materials, abrasive particles, microspheres, or soluble additives in the polymer materials.

The surface pattern 104 is disposed in the polishing layer 102. According to the present embodiment, the surface pattern 104 includes a plurality of traversing grooves 104*a*-104*d*. In the embodiment shown in FIG. 1, the traversing grooves 104*a*-104*d* are arc-shaped grooves, but the invention is not limited thereto. In other embodiments, the traversing grooves 104*a*-104*d* can also be straight line grooves or grooves having different shapes.

In addition, according to the present embodiment, the surface pattern 104 may further include at least one partition blank region B1-B3, the partition blank regions B1-B3 separate the traversing grooves 104*a*-104*d*, so that the traversing grooves 104*a*-104*d* do not connect to one another. Herein, the partition blank regions B1-B3 have a ring-shaped distribution on the polishing pad 100, and the traversing grooves 104*a*-104*d* collectively have an annulus distribution on the polishing pad 100.

In the present embodiment, the surface pattern 104 further includes an edge blank region E disposed on an edge of the polishing layer 102. The edge blank region E prevents the traversing grooves 104*a*-104*d* from extending to the edge of the polishing layer 102. The surface pattern 104 may optionally include a central blank region disposed close to a center of the polishing layer 102 (as shown in FIG. 1) or have the traversing groove 104*a* extends to the center of the polishing layer 102.

Furthermore, the carrier 110 includes a carrier ring 111 disposed at periphery of the carrier 110. The carrier ring 111 is mainly adopted to hold a substrate S within the carrier 110, such that the substrate S is pressed on a surface of the polishing layer 102 for polishing. Generally, the carrier ring 111 of the carrier 110 includes at least one carrier groove 112. The carrier ring 111 is a ring structure located at periphery of the carrier 110. The substrate S is held within the carrier 110 and encircled in the carrier ring 111.

Moreover, the substrate S is also referred as a polishing object, which includes a wafer, a glass substrate, a metal substrate, or other polishing objects, for example. The substrate S is pressed on the polishing layer 102 by the carrier 110 for polishing. The substrate S has a substrate radius r.

To perform a polishing process, the carrier 110 can hold and press the substrate S on the polishing layer 102 to perform the polishing process. When performing the polishing process, the polishing pad 100 has a motion direction D1. The motion direction D1 is perpendicular to a coordinate axis (for example, a radius coordinate axis) extended from an origin point (for example, a rotational center C) of the polishing pad 100. In other words, the polishing pad 100 rotates along the direction D1. Also, the carrier 110 holds the substrate S and rotates along a direction D2. With the polishing pad 100 rotating along the direction D1 and the carrier 110 rotating along the direction D2, a surface of the substrate S can be polished.

It should be noted that when performing the polishing process, an angle between a tangent line of each of the traversing grooves 104*a*-104*d* and a tangent line of the motion direction D1 of the polishing pad 100 is not equal to 0. That is, the tangent line of each of the traversing grooves 104*a*-104*d* and the tangent line of the motion direction D1 of the polishing pad 100 are not disposed in parallel. Therefore, the traversing grooves 104*a*-104*d* are generally arranged in a direction extending from the position closer to the rotational center C of the polishing pad 100 to the position closer to an edge of the polishing pad 100.

Further, the traversing grooves 104-104*d* respectively have a plurality of groove trajectories A1-A4 corresponding to the motion direction D1 of the polishing pad 100. In other words, when the polishing pad 100 rotates along the motion direction D1, the traversing groove 104*a* constitutes a groove trajectory A1 (that is, an outermost ring region), the traversing groove 104*b* constitutes a groove trajectory A2 (that is, a second outermost ring region), the traversing groove 104*c* constitutes a groove trajectory A3 (that is, a third outermost ring region), and the traversing groove 104*d* constitutes a groove trajectory A4 (that is, an innermost ring region). A width of each of the groove trajectories A1-A4 is, for example, larger than a width of each of the partition blank regions B1-B3 and a width of the edge blank region E. Here, the trajectory width of the groove trajectories A1-A4 means that when two terminals of the traversing groove extend outward from a first radius position to a second radius position relative to the rotational center C, a difference between the second radius and the first radius then equals to the trajectory width.

In the present embodiment, the width of each of the groove trajectories A1-A4 is smaller than the substrate radius r of the substrate S. That is, the traversing grooves 104*a*-104*d* each has two terminals located at a first position and a second position of the coordinate axis respectively. A first distance is from the first position to the origin point. A second distance is from the second position to the origin point. A difference between the second distance and the first distance is smaller than the substrate radius r. Take the traversing groove 104*a* as an example, a first terminal T1 of the traversing groove 104*a* is located at an outermost position of the partition blank region B1 and a second terminal T2 of the traversing groove 104*a* is located at an innermost position of the edge blank region E. A first distance is from the first terminal T1 of the traversing groove 104*a* to the origin point (the rotational center C). A second distance is from the second terminal T2 of the traversing groove 104*a* to the origin point (the rotational center C). A difference between the second distance and the first distance is smaller than the substrate radius r of the substrate S.

Accordingly, in the present embodiment, at least two of the non-completely overlapped groove trajectories among the groove trajectories A1-A4 and at least one partition blank region among the partition blank regions B1-B3 are covered by the substrate S.

It should be noted that the invention does not limit the number of the groove trajectories A1-A4 and the partition blank regions B1-B3. In other embodiments, the number of the groove trajectories in the polishing layer 102 can be more than or less than four, and the number of the partition blank regions can be more than or less than three. The number of the groove trajectories and the partition blank region can be altered suitably depending on demands as long as the guidelines of the invention are followed.

Further, according to the present embodiment, the traversing grooves 104*a*-104*d* are generally arranged as continuous curves virtually extended in radial direction on the polishing layer 102. The continuous curves virtually extended in radial direction have a spiral distribution or a radiant distribution collectively. In other words, the traversing grooves 104*a*-104*d* extend virtually from the position closer to the rotational center C of the polishing layer 102 to the position closer to an edge of the polishing layer 102 radially in a spiral or a radiant arrangement.

Moreover, the invention does not limit the number of the traversing grooves 104*a*-104*d*. In order to better illustrate the invention, only several of the traversing grooves 104*a*-104*d* are shown in the embodiment of FIG. 1. Comparing to FIG. 1, FIG. 2 illustrates more traversing grooves 104*a*-104*d* and the number of the traversing grooves 104*a*-104*d* can be determined according to the actual demand.

In general, when performing the polishing process, the polishing pad 100 rotates along the direction D1 and the carrier 110 rotates along the direction D2, so that the polishing pad 100 and the carrier 110 have a relative motion. However, in the polishing process aforementioned, a portion of the slurry flows to the edge of the polishing layer 102 due to the centrifugal force generated from the rotation of the polishing pad 100. Especially, at the contact region of the polishing layer 102 and the carrier 110, the slurry is further squeezed by the carrier ring 111 of the carrier 110 to the edge of the polishing layer 102 and thus flows out. It is more obvious in the leading region of the carrier ring 111 of the carrier 110 corresponding to the motion direction D1. According to the present embodiment, the leading region of the motion direction D1 generally corresponds to a lower edge region of the carrier ring 111 of the carrier 110.

Therefore, according to the present embodiment, the traversing grooves 104*a*-104*d* of the surface pattern 104 in the polishing layer 102 have at least one carrier compatible groove 140 in the leading region of the carrier ring 111 corresponding to the motion direction D1. The carrier compatible groove 140 aligns with the carrier groove 112 of the carrier ring 111. In details, among the traversing grooves 104*a*-104*d* in the polishing layer 102, at least one of the traversing grooves 104*a*-104*d* aligns with the carrier groove 112 of the carrier ring 111, and this traversing groove is referred as the carrier compatible groove 140. In the present embodiment, the carrier compatible groove 140 is disposed in the leading region of the carrier ring 111 corresponding to the motion direction D1.

Accordingly, the carrier compatible groove 140 of the present embodiment aligns with the carrier groove 112 in the leading region of the carrier ring 111 corresponding to the motion direction D1 so as to prevent the slurry from flowing out of the edge of the polishing layer 102 due to the squeezing of the carrier ring 111. In other words, a portion of the slurry is drawn into the carrier ring 111 by the rotation of the carrier 110 (the rotational direction D2) during the polishing with the facilitation of the design of the traversing grooves 104*a*-104*d* in the polishing layer 102 (the alignment of the carrier compatible groove 140 and the carrier groove 112). In addition, the width of each of the groove trajectories A1-A4 of the traversing grooves 104*a*-104*d* is smaller than the substrate radius r of the substrate S, that is, at least two non-completely overlapped groove trajectories and at least one partition blank region are covered by the substrate S. Consequently, the slurry not only flows from two sidewalls of the traversing grooves 104*a*-104*d* to an interface between the surface of the polishing layer 102 and the substrate S, but also flows from the terminals of the traversing grooves 104*a*-104*d* to the interface between the surface of the polishing layer 102 and the substrate S, thus it enables the slurry to have a different flow distribution.

Figure 3:
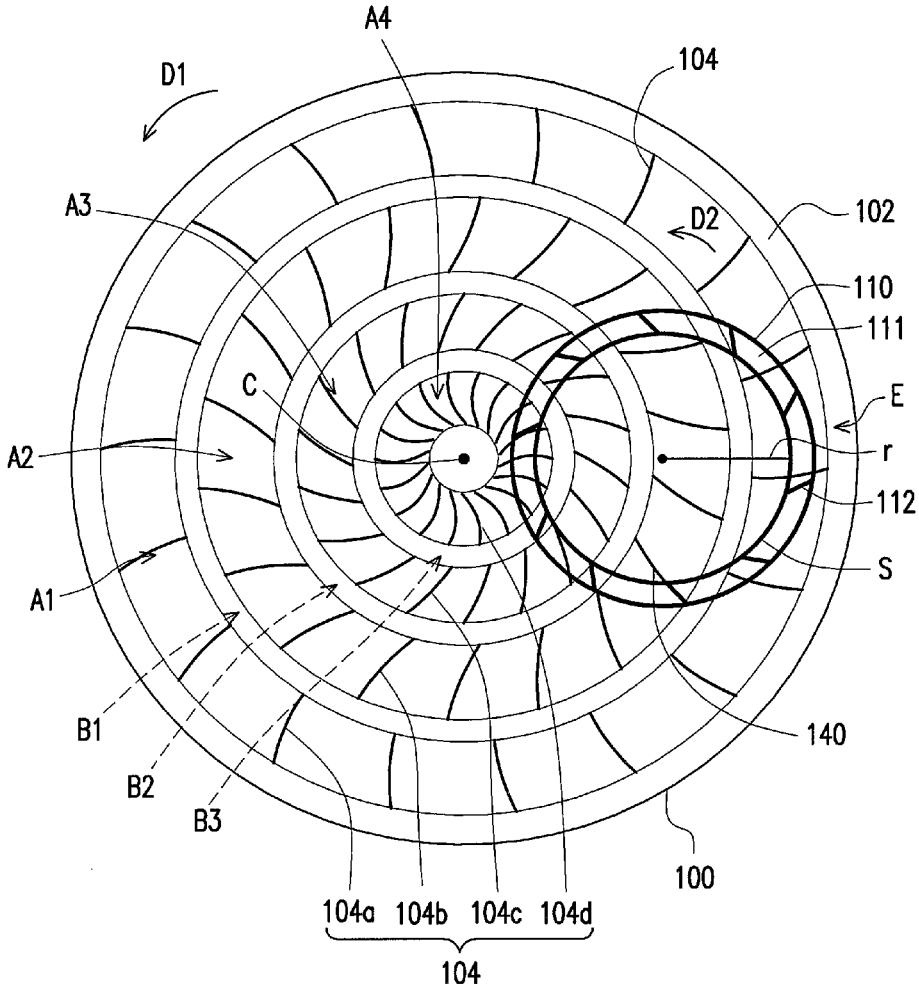
FIGS. 3 to 6 illustrate schematic top views showing a polishing system according to several embodiments of the invention.

FIG. 3 is a schematic top view showing a polishing system according to an embodiment of the invention. Referring to FIG. 3, the embodiment in FIG. 3 is similar to that in FIG. 1, and thus the elements identical to those in FIG. 1 are denoted with the same notations and the identical feature of the same element is not reiterated hereinafter. The embodiment in FIG. 3 is different from the embodiment in FIG. 1 in that the traversing grooves 104*a*-104*d* are staggered, such that the slurry flows to the surface of the polishing layer 102 more easily. In other words, in the embodiment shown in FIG. 1, the traversing grooves 104*a*-104*d* are generally arranged as continuous curves extend virtually in a radial manner. However, in the embodiment shown in FIG. 3, the traversing grooves 104*a*-104*d* in adjacent groove trajectories A1-A4 are arranged in staggers. That is, the traversing groove 104*a* and the traversing groove 104*b* are staggered, the traversing groove 104*b* and the traversing groove 104*c* are staggered, and the traversing groove 104*c* and the traversing groove 104*d* are staggered.

In the embodiments shown in FIGS. 1 to 3, the partition blank regions B1-B3 have a ring-shaped distribution on the polishing pad 100, and the traversing grooves 104*a*-104*d* collectively have an annulus distribution on the polishing pad 100. However, the invention is not limited thereto. In other embodiments, a distribution of the partition blank regions on the polishing pad 102 can also have a shape of a concentric ring, a non-concentric ring, an elliptical ring, a wavy ring, an irregular ring, multiple lines, parallel lines, radiant lines, radiant arcs, a spiral, a polyangular cell, or a combination thereof; corresponding to the different partition blank regions aforementioned, the distribution of the traversing grooves collectively on the polishing pad has a shape of an annulus, a concentric annulus, a non-concentric annulus, an elliptical annulus, a wavy annulus, an irregular annulus, an arc band, a concentric arc band, a non-concentric arc band, an elliptical arc band, a wavy arc band, an irregular arc band, a line band, parallel line bands, a radiant line sector, a radiant arc sector, a spiral band, a polyangular cell, or a combination thereof.

Figure 4:
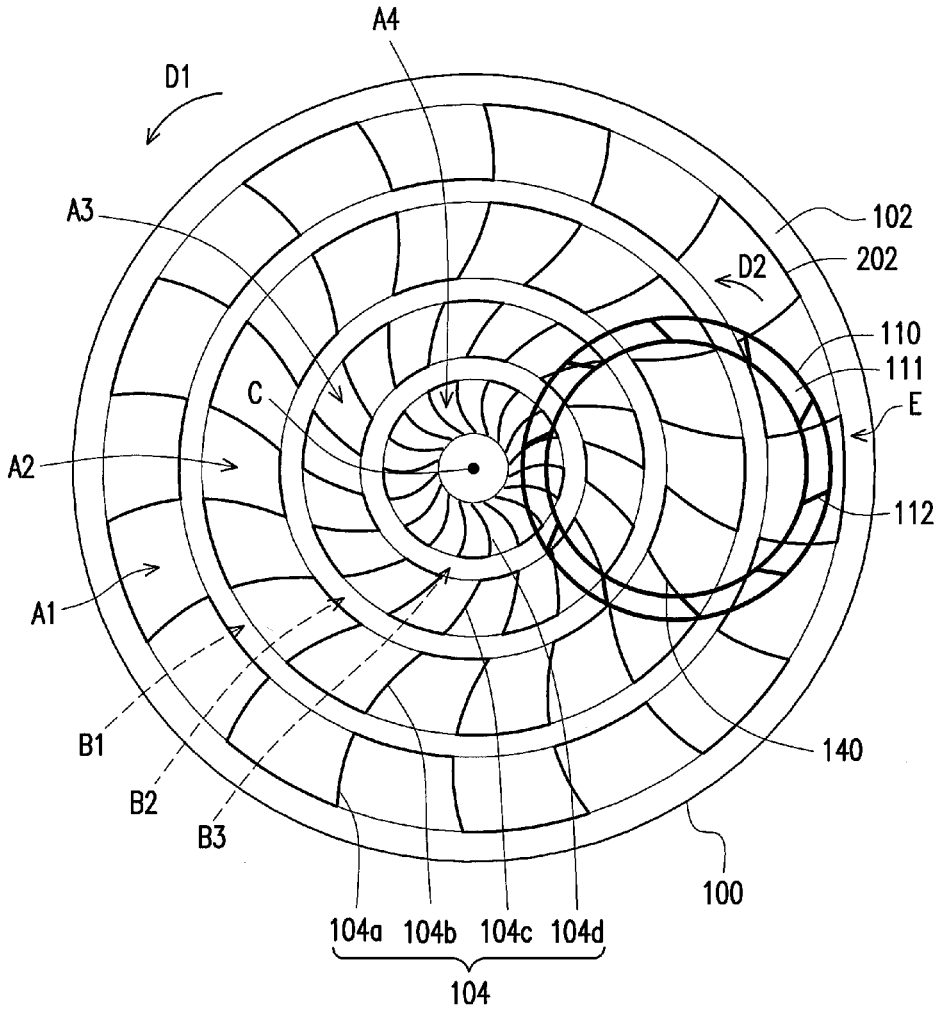

FIG. 4 is a schematic top view showing a polishing system according to an embodiment of the invention. Referring to FIG. 4, the embodiment in FIG. 4 is similar to that in FIG. 1, and thus the elements identical to those in FIG. 1 are denoted with the same notations and the identical feature of the same element is not reiterated hereinafter. The embodiment in FIG. 4 is different from the embodiment in FIG. 1 in that the surface pattern 104 in the polishing layer 102 further includes a plurality of connection grooves 202. The connection grooves 202 connect the traversing grooves 104*a*-104*d* and are located at boundaries of the partition blank regions B1-B3 and the edge blank region E. The connection grooves 202 collectively have a concentric arc distribution. That is, a direction of the connection grooves 202 coincides with the motion direction D1 of the polishing pad 100; or, a tangent line of each of the connection grooves 202 and the tangent line of the motion direction D1 of the polishing pad 100 are in parallel. The connection grooves 202 and the traversing grooves 104*a*-104*d* are connected to form a sawtooth shape. The sawtooth patterns are optionally separated by the partition blank regions B1-B3. Specifically, the connection grooves 202 connect all the traversing grooves 104*a* to form an annulus sawtooth groove pattern; the connection grooves 202 connect all the traversing grooves 104*b* to form another annulus sawtooth groove pattern; the connection grooves 202 connect all the traversing grooves 104*c* to form another annulus sawtooth groove pattern; and the connection grooves 202 connect all the traversing grooves 104*d* to form another annulus sawtooth groove pattern.

Figure 5:
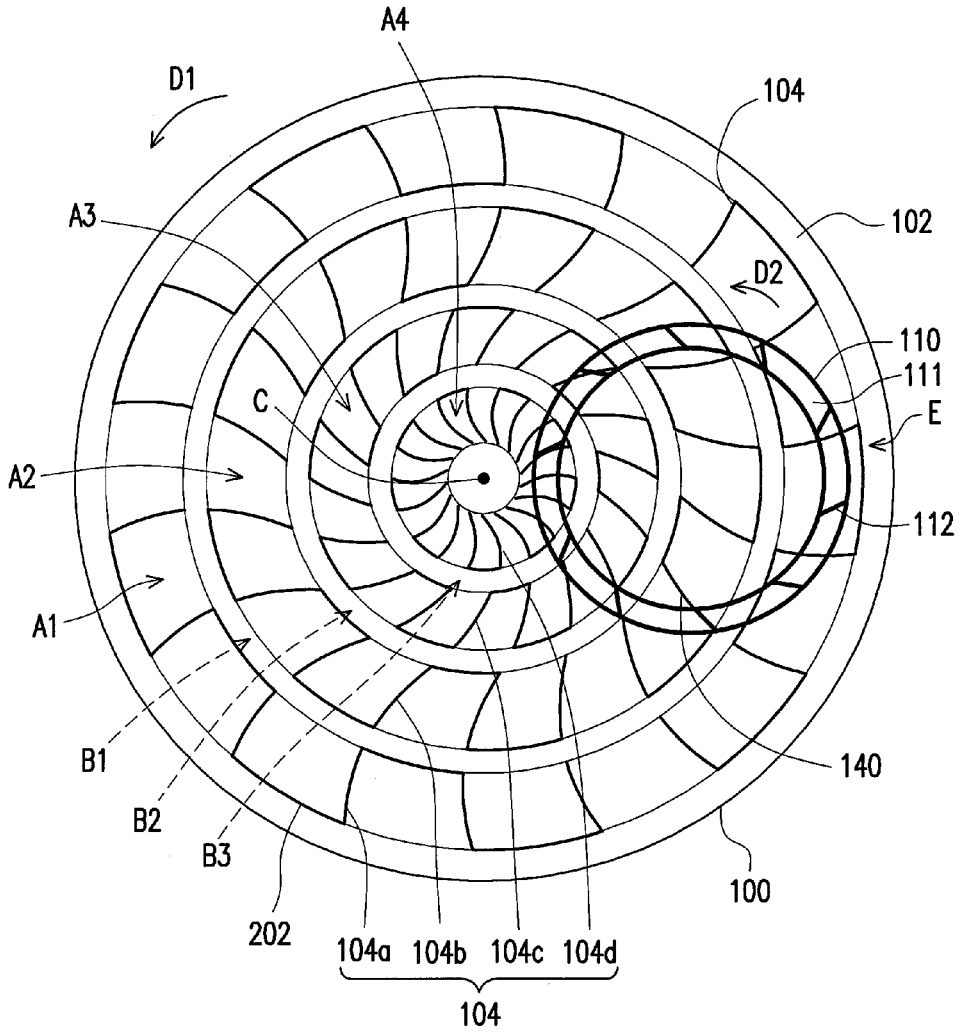

FIG. 5 is a schematic top view showing a polishing system according to an embodiment of the invention. Referring to FIG. 5, the embodiment in FIG. 5 is similar to that in FIG. 4, and thus the elements identical to those in FIG. 4 are denoted with the same notations and the identical feature of the same element is not reiterated hereinafter. The embodiment in FIG. 5 is different from the embodiment in FIG. 4 in that the connection grooves 202 connect a portion of the traversing grooves 104*a*-104*d* to form an arc band sawtooth shape. Specifically, the connection grooves 202 connect a portion of the traversing grooves 104*a* to form a plurality of arc band sawtooth groove patterns; the connection grooves 202 connect a portion of the traversing grooves 104*b* to form a plurality of arc band sawtooth groove patterns; the connection grooves 202 connect a portion of the traversing grooves 104*c* to form a plurality of arc band sawtooth groove patterns; and the connection grooves 202 connect a portion of the traversing grooves 104*d* to form a plurality of arc band sawtooth groove patterns.

In the embodiments illustrated in FIGS. 4 and 5, the partition blank regions B1-B3 have a ring distribution and the sawtooth groove patterns formed by one of the traversing grooves 104*a*-104*d* and the connection grooves 202 are annuli or arc bands. However, the invention is not limited thereto. According to other embodiments, a distribution of the partition blank regions on the polishing layer 102 can also have a shape of a concentric ring, a non-concentric ring, an elliptical ring, a wavy ring, an irregular ring, multiple lines, parallel lines, radiant lines, radiant arcs, a spiral, a polyangular cell, or a combination thereof; the sawtooth groove patterns formed corresponding to the different partition blank regions aforementioned have a shape of an annulus, a concentric annulus, a non-concentric annulus, an elliptical annulus, a wavy annulus, an irregular annulus, an arc band, a concentric arc band, a non-concentric arc band, an elliptical arc band, a wavy arc band, an irregular arc band, a line band, parallel line bands, a radiant line sector, a radiant arc sector, a spiral band, a polyangular cell, or a combination thereof.

In the embodiments shown in FIGS. 1 to 5, the groove trajectories A1-A4 of the traversing grooves 104*a*-104*d* corresponding to the motion direction D1 of the polishing pad 100 are completely overlapped (for example, the groove trajectories A1 corresponding to all the traversing grooves 104*a* on the outermost layer are completely overlapped) or completely not overlapped (for example, the groove trajectories A1-A4 corresponding to the traversing grooves 104*a*-104*d* are completely not overlapped) for illustration. However, the invention is not limited thereto. According to other embodiments, the groove trajectories of the traversing grooves corresponding to the motion direction of the polishing pad can be completely overlapped, partially overlapped, completely not overlapped, or a combination thereof. Additionally, the distribution of the partition blank regions is illustrated in lines; however, the distribution of the partition blank regions defined by the invention can also be illustrated in bands.

Figure 6:
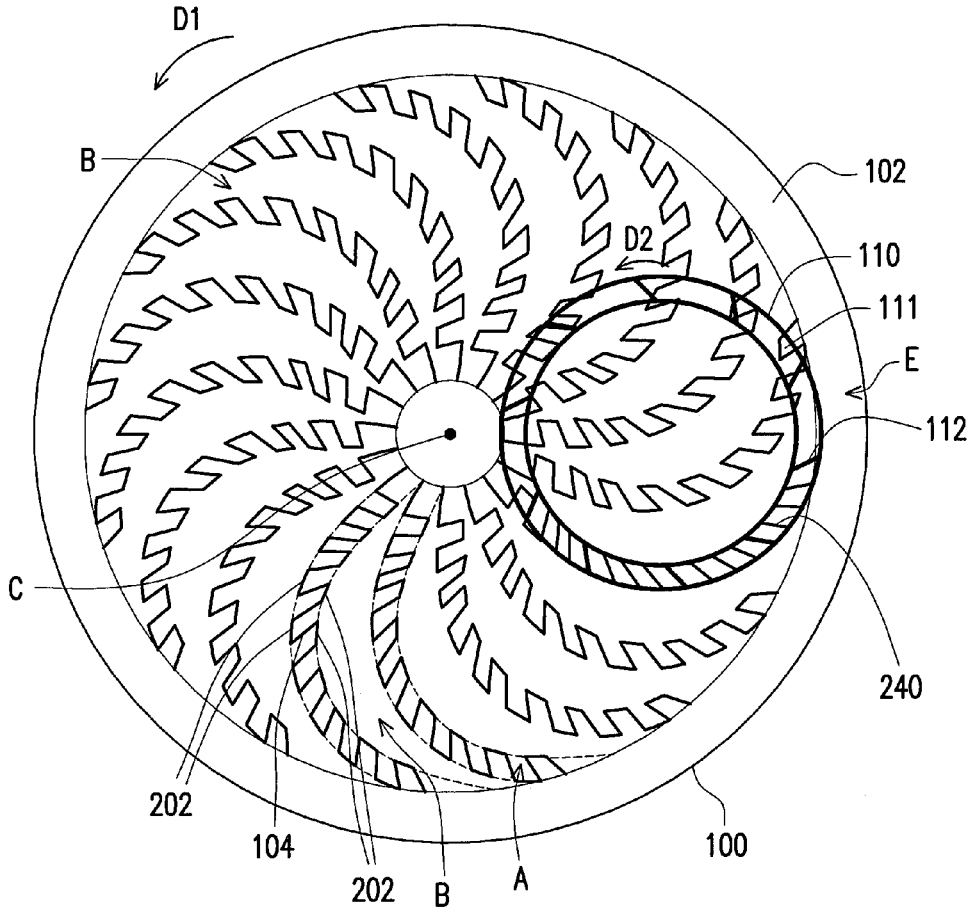
Figure 7:
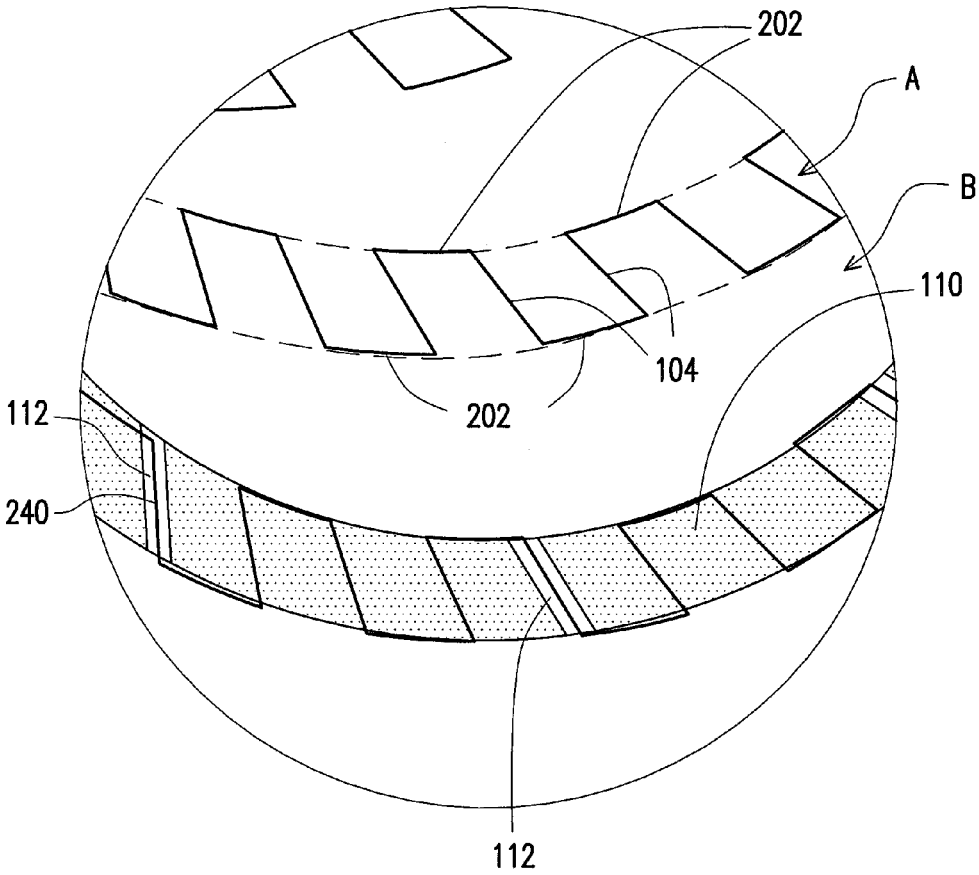
FIG. 7 illustrates a schematic partial enlarged view of a carrier ring in FIG. 6.

FIG. 6 is a schematic top view showing a polishing system according to an embodiment of the invention. FIG. 7 illustrates a schematic partial enlarged view of a carrier ring in FIG. 6. Referring to FIGS. 6 and 7, the embodiment in FIG. 6 is similar to that in FIG. 1, and thus the elements identical to those in FIG. 1 are denoted with the same notations and the identical feature of the same element is not reiterated hereinafter. The embodiments in FIGS. 6 and 7 are different from the embodiment in FIG. 1 in that a plurality of partition blank regions B in the surface pattern of the polishing layer has a spiral shaped arrangement, the polishing layer 102 has the traversing grooves 104, and the partition blank regions B separate the traversing grooves 104 into a plurality of arc band regions A, so that the traversing grooves 104 have a spiral band shape collectively (located in the arc band regions A). The surface pattern of the polishing layer 102 further includes the connection grooves 202. The connection grooves 202 are located between the traversing grooves 104, for example, and distributed at the boundaries of the traversing grooves 104 and the partition blank regions B. The connection grooves 202 collectively have a non-continuous spiral distribution. The connection grooves 202 and the traversing grooves 104 are connected to form a sawtooth shape. The sawtooth groove patterns are separated by the partition blank regions B, for instance. In details, the connection grooves 202 connect the traversing grooves 104 to form the spiral band sawtooth groove patterns. Particularly, when performing the polishing process, the polishing pad 100 and the carrier 110 have a relative motion. The traversing grooves 104 in the polishing layer 102 have at least one carrier compatible groove 240 in the leading region of the carrier ring 111 corresponding to the motion direction D1. The carrier compatible groove 240 aligns with the carrier groove 112 of the carrier ring 111. In details, among the traversing grooves 104 in the polishing layer 102, at least one of the traversing grooves 104 aligns with the carrier groove 112 of the carrier ring 111, and this traversing groove 104 is referred as the carrier compatible groove 240. In the present embodiment, the carrier compatible groove 240 is disposed in the leading region of the carrier ring 111 corresponding to the motion direction D1.

Similarly, the carrier compatible groove 240 of the present embodiment aligns with the carrier groove 112 in the leading region of the carrier ring 111 corresponding to the motion direction D1. The slurry is thus prevented from flowing out of the edge of the polishing layer 102 due to the squeezing of the carrier ring 111. Therefore, a portion of the slurry is drawn into the carrier ring 111 by the rotation of the carrier 110 (the rotational direction D2) during the polishing. In addition, the width of each of the groove trajectories of the traversing grooves 104 is smaller than the substrate radius r of the substrate S, that is, at least two non-completely overlapped groove trajectories and at least one partition blank region are covered by the substrate S. Consequently, the slurry not only flows from two sidewalls of the traversing grooves 104 to an interface between the surface of the polishing layer 102 and the substrate S, but also flows from the terminals of the traversing grooves 104 to the interface between the surface of the polishing layer 102 and the substrate S, thus it enables the slurry to have a different flow distribution.

In the embodiment shown in FIG. 6, separated by the partition blank regions B, the arc band regions A, constituted by the traversing grooves 104 collectively, can optionally have the same width as the carrier ring 111 substantially. A curvature of the arc band regions A, constituted by the traversing grooves 104, can also optionally be identical to a curvature of the leading region of the carrier ring 111 substantially. That is, in the leading region corresponding to the motion direction D1, when the carrier ring 111 moves above one of the arc bands, the carrier ring 111 can completely cover the arc band substantially.

In addition, in the present embodiment of FIG. 6, the arc bands, constituted by the traversing grooves 104, extend from the same inner radial position outward to the same outer radial position for illustration. However, the invention is not limited thereto. According to other embodiments, the arc bands, constituted by the traversing grooves 104, can optionally extend from different inner radial positions outward to different outer radial positions to adjust a groove density of the traversing grooves 104 on different positions on the surface of the polishing layer 102 to have a more uniform overall groove density.

Figure 8:
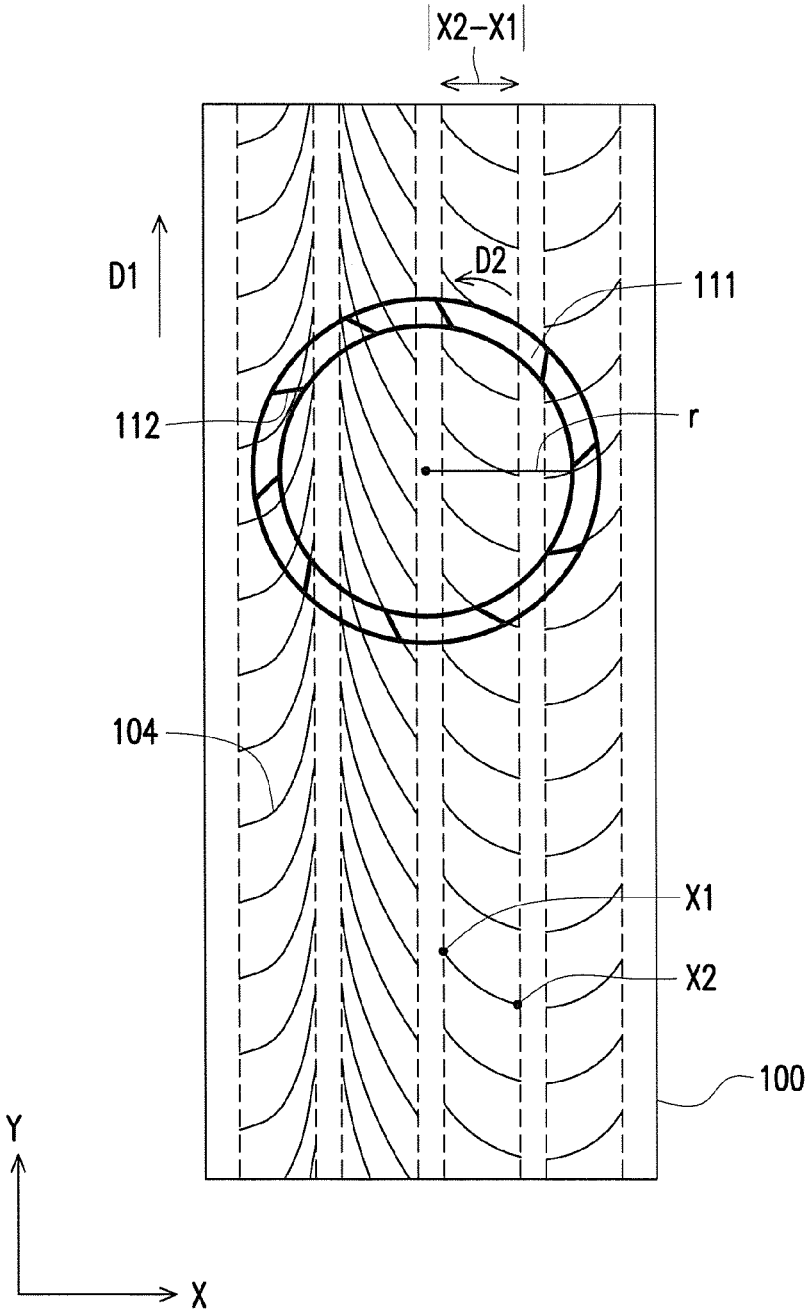
FIG. 8 is a schematic top view showing a polishing system according to another embodiment of the invention.

In the embodiments depicted in FIGS. 1 to 7, the polishing pad 100 is illustrated with a circular polishing pad. However, the design of the traversing grooves in the invention can also be applied to polishing pads of other shapes, for example, a band-shaped polishing pad. In general, as shown in FIG. 8, the motion direction D1 of the band-shaped polishing pad 100 is a linear movement. Thus, when the motion direction D1 of the band-shaped polishing pad 100 is a linear Y direction, for instance, the motion direction D1 is perpendicular to a coordinate axis (for example, an X axis) extended from an origin point (for example, X=0), and the two terminals of the traversing groove, located on the band-shaped polishing pad 100, extend from an X1 position to an X2 position of the polishing pad 100. In other words, in the band-shaped polishing pad 100, a tangent line of each of the traversing grooves 104 and the Y direction include a non-zero angle. Additionally, each of the traversing grooves 104 has a groove trajectory corresponding to a motion direction of the band-shaped polishing pad and $|X2-X1|$ equals to the trajectory width, and the trajectory width is smaller than the substrate radius r. Particularly, in the leading region of the carrier ring corresponding to the motion direction of the band-shaped polishing pad, the traversing grooves have at least one carrier compatible groove. The at least one carrier compatible groove aligns with the at least one carrier groove to enable the slurry to have a different flow distribution.

In summary, the traversing grooves of the polishing pad in the invention have at least one carrier compatible groove in the leading region of the carrier ring corresponding to the motion direction, and the at least one carrier compatible groove aligns with the at least one carrier groove. Accordingly, when performing the polishing process, the slurry flows along the grooves to generate the corresponding flow distribution.

The polishing pad of the invention allows the slurry to obtain a different flow distribution. For certain polishing processes, the slurry may be used more efficiently so as to reduce the consumption of the slurry, thereby decreasing the cost. For other certain polishing processes, different polishing performances such as enhancing the polishing rate of the substrate or reducing the polishing time may be obtained as options for the industry.

It will be apparent to those skilled in the art that various modifications and variations can be made to the structure of the disclosed embodiments without departing from the scope or spirit of the invention. In view of the foregoing, it is intended that the invention cover modifications and variations of this invention provided they fall within the scope of the following claims and their equivalents.

What is claimed is:

1. A polishing pad used in conjunction with a carrier ring to polish a substrate, the polishing pad having a motion direction when polishing, wherein the carrier ring has at least one carrier groove and the substrate has a substrate radius, the polishing pad comprising:

a polishing layer; and a surface pattern disposed in the polishing layer, the surface pattern having a plurality of traversing grooves, a tangent line of each of the traversing grooves and a tangent line of the motion direction including a non-zero angle, and each of the traversing grooves having a traversing groove trajectory corresponding to the motion direction, wherein the traversing groove trajectory is a region where each of the traversing grooves passes by when the polishing pad moves in the motion direction, and each of the traversing groove trajectories having a trajectory width smaller than the substrate radius, wherein in a leading region of the carrier ring corresponding to the motion direction, the traversing grooves have at least one carrier compatible groove, and the at least one carrier compatible groove aligns with the at least one carrier groove.

2. The polishing pad as claimed in claim 1, wherein the traversing grooves are arc-shaped grooves or straight line grooves.

3. The polishing pad as claimed in claim 2, wherein the surface pattern further comprises at least one partition blank region, the at least one partition blank region separates the traversing grooves, and a distribution shape of the at least one partition blank region has a shape of a ring, a concentric ring, a non-concentric ring, an elliptical ring, a wavy ring, an irregular ring, multiple lines, parallel lines, radiant lines, radiant arcs, a spiral, a polyangular cell, or a combination thereof.

4. The polishing pad as claimed in claim 3, wherein the surface pattern further comprises an edge blank region disposed on an edge of the polishing layer, the edge blank region prevents the traversing grooves from extending to the edge of the polishing layer.

5. The polishing pad as claimed in claim 1, wherein the surface pattern further comprises a plurality of connection grooves, the connection grooves and the traversing grooves connect to form a sawtooth shape.

6. The polishing pad as claimed in claim 5, wherein a pattern constituted by the traversing grooves and the connection grooves comprises an annulus, a concentric annulus, a non-concentric annulus, an elliptical annulus, a wavy annulus, an irregular annulus, an arc band, a concentric arc band, a non-concentric arc band, an elliptical arc band, a wavy arc band, an irregular arc band, a line band, parallel line bands, a radiant line sector, a radiant arc sector, a spiral band, a polyangular cell, or a combination thereof.

7. The polishing pad as claimed in claim 3, wherein a portion of at least two of the groove trajectories non-completely overlapped and a portion of the at least one partition blank region are covered by the substrate.

8. The polishing pad as claimed in claim 1, wherein the motion direction is a rotational direction rotating along a rotational center, the traversing grooves each has two terminals extending outward from a first radius position to a second radius position relative to the rotational center, and a difference between the second radius and the first radius equals to the trajectory width.

9. The polishing pad as claimed in claim 1, wherein the motion direction is a linear Y direction, the traversing grooves each has two terminals extending from an X1 position to an X2 position of the polishing pad, and $|X2-X1|$ equals to the trajectory width.

10. A polishing pad used in conjunction with a carrier ring to polish a substrate, the polishing pad having a motion direction when polishing, wherein the carrier ring has at least one carrier groove and the substrate has a substrate radius, the motion direction is perpendicular to a coordinate axis extended from an origin point, the polishing pad comprising:

a polishing layer; and a surface pattern disposed in the polishing layer, the surface pattern having a plurality of traversing grooves, the traversing grooves each having two terminals located at a first position and a second position of the coordinate axis respectively, a first distance being from the first position to the origin point, a second distance being from the second position to the origin point, the second distance being larger than the first distance, and a difference between the second distance and the first distance being smaller than the substrate radius, wherein in a leading region of the carrier ring corresponding to the motion direction, the traversing grooves have at least one carrier compatible groove, and the at least one carrier compatible groove aligns with the at least one carrier groove.

11. The polishing pad as claimed in claim 10, wherein the traversing grooves are arc-shaped grooves or straight line grooves.

12. The polishing pad as claimed in claim 11, wherein the surface pattern further comprises at least one partition blank region, the at least one partition blank region separates the traversing grooves, and a distribution shape of the at least one partition blank region has a shape of a ring, a concentric ring, a non-concentric ring, an elliptical ring, a wavy ring, an irregular ring, multiple lines, parallel lines, radiant lines, radiant arcs, a spiral, a polyangular cell, or a combination thereof.

13. The polishing pad as claimed in claim 12, wherein the surface pattern further comprises an edge blank region disposed on an edge of the polishing layer, the edge blank region prevents the traversing grooves from extending to the edge of the polishing layer.

14. The polishing pad as claimed in claim 10, wherein the surface pattern further comprises a plurality of connection grooves, the connection grooves and the traversing grooves connect to form a sawtooth shape.

15. The polishing pad as claimed in claim 14, wherein a pattern constituted by the traversing grooves and the connection grooves comprises an annulus, a concentric annulus, a non-concentric annulus, an elliptical annulus, a wavy annulus, an irregular annulus, an arc band, a concentric arc band, a non-concentric arc band, an elliptical arc band, a wavy arc band, an irregular arc band, a line band, parallel line bands, a radiant line sector, a radiant arc sector, a spiral band, a polyangular cell, or a combination thereof.

16. The polishing pad as claimed in claim 10, wherein the motion direction is a rotational direction rotating along the origin point, the coordinate axis is a radius coordinate axis, the first position is a first radius position and the second position is a second radius position.

17. The polishing pad as claimed in claim 10, wherein the motion direction is a linear Y direction, the coordinate axis is an X coordinate axis, the first position is an X1 position, and the second position is an X2 position.

18. A polishing method, comprising:

providing a polishing pad, the polishing pad comprising:

a polishing layer; and a surface pattern, disposed in the polishing layer and having a plurality of traversing grooves;

providing a carrier, the carrier having a carrier ring for holding a substrate within the carrier, wherein the carrier ring has at least one carrier groove and the substrate has a substrate radius;

pressing the substrate on the polishing pad with the carrier to perform a polishing process, the polishing pad having a motion direction during the polishing process, wherein a tangent line of each of the traversing grooves of the polishing pad and a tangent line of the motion direction include a non-zero angle, and each of the traversing grooves respectively has a traversing groove trajectory corresponding to the motion direction, wherein the traversing groove trajectory is a region where each of the traversing grooves passes by when the polishing pad moves in the motion direction, and each of the traversing groove trajectories has a trajectory width smaller than the substrate radius, and in a leading region of the carrier ring corresponding to the motion direction, the traversing grooves have at least one carrier compatible groove, and the at least one carrier compatible groove aligns with the at least one carrier groove.

19. The polishing method as claimed in claim 18, wherein the traversing grooves are arc-shaped grooves or straight line grooves.

20. The polishing method as claimed in claim 19, wherein the surface pattern further comprises at least one partition blank region, the at least one partition blank region separates the traversing grooves, and a distribution shape of the at least one partition blank region has a shape of a ring, a concentric ring, a non-concentric ring, an elliptical ring, a wavy ring, an irregular ring, multiple lines, parallel lines, radiant lines, radiant arcs, a spiral, a polyangular cell, or a combination thereof.

21. The polishing method as claimed in claim 20, wherein the surface pattern further comprises an edge blank region disposed on an edge of the polishing layer, the edge blank region prevents the traversing grooves from extending to the edge of the polishing layer.

22. The polishing method as claimed in claim 18, wherein the surface pattern further comprises a plurality of connection grooves, the connection grooves and the traversing grooves connect to form a sawtooth shape.

23. The polishing method as claimed in claim 22, wherein a pattern constituted by the traversing grooves and the connection grooves comprises an annulus, a concentric annulus, a non-concentric annulus, an elliptical annulus, a wavy annulus, an irregular annulus, an arc band, a concentric arc band, a non-concentric arc band, an elliptical arc band, a wavy arc band, an irregular arc band, a line band, parallel line bands, a radiant line sector, a radiant arc sector, a spiral band, a polyangular cell, or a combination thereof.

24. The polishing pad as claimed in claim 20, wherein a portion of at least two of the groove trajectories non-completely overlapped and a portion of the at least one partition blank region are covered by the substrate.

25. The polishing method as claimed in claim 18, wherein the motion direction is a rotational direction rotating along a rotational center, the traversing grooves each has two terminals extending outward from a first radius position to a second radius position relative to the rotational center, and a difference between the second radius and the first radius equals to the trajectory width.

26. The polishing method as claimed in claim 18, wherein the motion direction is a linear Y direction, the traversing grooves each has two terminals extending from an X1 position to an X2 position of the polishing pad, and $|X2-X1|$ equals to the trajectory width.

27. A polishing method, comprising:

providing a polishing pad, the polishing pad comprising:

a polishing layer; and a surface pattern, disposed in the polishing layer and having a plurality of traversing grooves;

providing a carrier, the carrier having a carrier ring for holding a substrate within the carrier, wherein the carrier ring has at least one carrier groove and the substrate has a substrate radius;

pressing the substrate on the polishing pad with the carrier to perforin a polishing process, the polishing pad having a motion direction during the polishing process, and the motion direction being perpendicular to a coordinate axis extended from an origin point, wherein the traversing grooves each has two terminals located at a first position and a second position of the coordinate axis respectively, a first distance is from the first position to the origin point, a second distance is from the second position to the origin point, the second distance is larger than the first distance, and a difference between the second distance and the first distance is smaller than the substrate radius, and in a leading region of the carrier ring corresponding to the motion direction, the traversing grooves have at least one carrier compatible groove, and the at least one carrier compatible groove aligns with the at least one carrier groove.

28. The polishing method as claimed in claim 27, wherein the traversing grooves are arc-shaped grooves or straight line grooves.

29. The polishing method as claimed in claim 28, wherein the surface pattern further comprises at least one partition blank region, the at least one partition blank region separates the traversing grooves, and a distribution shape of the at least one partition blank region has a shape of a ring, a concentric ring, a non-concentric ring, an elliptical ring, a wavy ring, an irregular ring, multiple lines, parallel lines, radiant lines, radiant arcs, a spiral, a polyangular cell, or a combination thereof.

30. The polishing method as claimed in claim 29, wherein the surface pattern further comprises an edge blank region disposed on an edge of the polishing layer, the edge blank region prevents the traversing grooves from extending to the edge of the polishing layer.

31. The polishing method as claimed in claim 27, wherein the surface pattern further comprises a plurality of connection grooves, the connection grooves and the traversing grooves connect to form a sawtooth shape.

32. The polishing method as claimed in claim 31, wherein a pattern constituted by the traversing grooves and the connection grooves comprises an annulus, a concentric annulus, a non-concentric annulus, an elliptical annulus, a wavy annulus, an irregular annulus, an arc band, a concentric arc band, a non-concentric arc band, an elliptical arc band, a wavy arc band, an irregular arc band, a line band, parallel line bands, a radiant line sector, a radiant arc sector, a spiral band, a polyangular cell, or a combination thereof.

33. The polishing method as claimed in claim 27, wherein the motion direction is a rotational direction rotating along the origin point, the coordinate axis is a radius coordinate axis, the first position is a first radius position and the second position is a second radius position.

34. The polishing method as claimed in claim 27, wherein the motion direction is a linear Y direction, the coordinate axis is an X coordinate axis, the first position is an X1 position, and the second position is an X2 position.

35. A polishing system, comprising:

a polishing pad, comprising:

a polishing layer; and a surface pattern, disposed in the polishing layer and having a plurality of traversing grooves;

a carrier having a carrier ring, the carrier ring having at least one carrier groove;

a substrate, held within the carrier and having a substrate radius;

the polishing pad having a motion direction when the carrier presses the substrate on the polishing pad for polishing, wherein a tangent line of each of the traversing grooves of the polishing pad and a tangent line of the motion direction include a non-zero angle, and each of the traversing grooves respectively has a traversing groove trajectory corresponding to the motion direction, wherein the traversing groove trajectory is a region where each of the traversing grooves passes by when the polishing pad moves in the motion direction, and each of the traversing groove trajectories has a trajectory width smaller than the substrate radius, and in a leading region of the carrier ring corresponding to the motion direction, the traversing grooves have at least one carrier compatible groove, and the at least one carrier compatible groove aligns with the at least one carrier groove.

36. The polishing system as claimed in claim 35, wherein the traversing grooves are arc-shaped grooves or straight line grooves.

37. The polishing system as claimed in claim 36, wherein the surface pattern further comprises at least one partition blank region, the at least one partition blank region separates the traversing grooves, and a distribution shape of the at least one partition blank region has a shape of a ring, a concentric ring, a non-concentric ring, an elliptical ring, a wavy ring, an irregular ring, multiple lines, parallel lines, radiant lines, radiant arcs, a spiral, a polyangular cell, or a combination thereof.

38. The polishing system as claimed in claim 37, wherein the surface pattern further comprises an edge blank region disposed on an edge of the polishing layer, the edge blank region prevents the traversing grooves from extending to the edge of the polishing layer.

39. The polishing system as claimed in claim 35, wherein the surface pattern further comprises a plurality of connection grooves, the connection grooves and the traversing grooves connect to form a sawtooth shape.

40. The polishing system as claimed in claim 39, wherein a pattern constituted by the traversing grooves and the connection grooves comprises an annulus, a concentric annulus, a non-concentric annulus, an elliptical annulus, a wavy annulus, an irregular annulus, an arc band, a concentric arc band, a non-concentric arc band, an elliptical arc band, a wavy arc band, an irregular arc band, a line band, parallel line bands, a radiant line sector, a radiant arc sector, a spiral band, a polyangular cell, or a combination thereof.

41. The polishing system as claimed in claim 35, wherein a portion of at least two of the groove trajectories non-completely overlapped and a portion of the at least one partition blank region are covered by the substrate.

42. The polishing system as claimed in claim 35, wherein the motion direction is a rotational direction rotating along a rotational center, the traversing grooves each has two terminals extending outward from a first radius position to a second radius position relative to the rotational center, and a difference between the second radius and the first radius equals to the trajectory width.

43. The polishing method as claimed in claim 35, wherein the motion direction is a linear Y direction, the traversing grooves each has two terminals extending from an X1 position to an X2 position of the polishing pad, and $|X2-X1|$ equals to the trajectory width.

44. A polishing system, comprising:

a polishing pad, comprising:

a polishing layer; and a surface pattern, disposed in the polishing layer and having a plurality of traversing grooves;

a carrier having a carrier ring, the carrier ring having at least one carrier groove;

a substrate, held within the carrier and having a substrate radius;

the polishing pad having a motion direction when the carrier presses the substrate on the polishing pad to perform a polishing process, the motion direction being perpendicular to a coordinate axis extended from an origin point, wherein the traversing grooves each has two terminals located at a first position and a second position of the coordinate axis respectively, a first distance is from the first position to the origin point, a second distance is from the second position to the origin point, the second distance is larger than the first distance, and a difference between the second distance and the first distance is smaller than the substrate radius, and in a leading region of the carrier ring corresponding to the motion direction, the traversing grooves have at least one carrier compatible groove, and the at least one carrier compatible groove aligns with the at least one carrier groove.

45. The polishing system as claimed in claim 44, wherein the traversing grooves are arc-shaped grooves or straight line grooves.

46. The polishing system as claimed in claim 45, wherein the surface pattern further comprises at least one partition blank region, the at least one partition blank region separates the traversing grooves, and a distribution shape of the at least one partition blank region has a shape of a ring, a concentric ring, a non-concentric ring, an elliptical ring, a wavy ring, an irregular ring, multiple lines, parallel lines, radiant lines, radiant arcs, a spiral, a polyangular cell, or a combination thereof.

47. The polishing system as claimed in claim 46, wherein the surface pattern further comprises an edge blank region disposed on an edge of the polishing layer, the edge blank region prevents the traversing grooves from extending to the edge of the polishing layer.

48. The polishing system as claimed in claim 44, wherein the surface pattern further comprises a plurality of connection grooves, the connection grooves and the traversing grooves connect to form a sawtooth shape.

49. The polishing system as claimed in claim 48, wherein a pattern constituted by the traversing grooves and the connection grooves comprises an annulus, a concentric annulus, a non-concentric annulus, an elliptical annulus, a wavy annulus, an irregular annulus, an arc band, a concentric arc band, a non-concentric arc band, an elliptical arc band, a wavy arc band, an irregular arc band, a line band, parallel line bands, a radiant line sector, a radiant arc sector, a spiral band, a poly-angular cell, or a combination thereof.

50. The polishing system as claimed in claim 44, wherein the motion direction is a rotational direction rotating along the origin point, the coordinate axis is a radius coordinate axis, the first position is a first radius position and the second position is a second radius position.

51. The polishing system as claimed in claim 44, wherein the motion direction is a linear Y direction, the coordinate axis is an X coordinate axis, the first position is an X1 position, and the second position is an X2 position.

* * * * *